US011176912B1

(12) United States Patent
Moon

(10) Patent No.: US 11,176,912 B1
(45) Date of Patent: Nov. 16, 2021

(54) MODULAR MULTI PLATE STRINGED INSTRUMENT ARCHITECTURE

(71) Applicant: Kevin Loren Moon, Vancouver, WA (US)

(72) Inventor: Kevin Loren Moon, Vancouver, WA (US)

( * ) Notice: Subject to any disclaimer, the term of this patent is extended or adjusted under 35 U.S.C. 154(b) by 0 days.

(21) Appl. No.: 16/824,604

(22) Filed: Mar. 19, 2020

Related U.S. Application Data

(60) Provisional application No. 62/821,322, filed on Mar. 20, 2019.

(51) Int. Cl.
*G10D 3/22* (2020.01)
*G10D 1/08* (2006.01)

(52) U.S. Cl.
CPC ..... *G10D 1/085* (2013.01); *G10D 3/22* (2020.02)

(58) Field of Classification Search
CPC ..... G10D 1/085; G10D 3/22
See application file for complete search history.

(56) References Cited

U.S. PATENT DOCUMENTS

2008/0105101 A1* 5/2008 Eldring ..... G10D 1/085 84/291

* cited by examiner

*Primary Examiner* — Kimberly R Lockett

(57) ABSTRACT

This invention describes a new Modular Multi-Plate Stringed Instrument Body Architecture that utilizes a front plate or plurality of front plates, a back plate or plurality of back plates, and central stiffening and connecting assembly and/or spacer blocks that connect the plates and distribute the forces created by string tension throughout the system in order to create an instrument body that is light weight, modular, modifiable and repairable. The use of modern composites such as carbon fiber allows for the instrument body to be designed as a beam structure such that the stiffness, resonance, and tone of the system can be controlled by varying the thickness, geometry, and material of the plates and connecting members. Said assembly can be dismantled and components changed to meet the user's needs and desires giving increased control over performance parameters compared to existing designs.

9 Claims, 6 Drawing Sheets

MODULAR MULTI PLATE STRINGED INSTRUMENT ARCHITECTURE

CROSS REFERENCE TO RELATED APPLICATIONS

This application claims the benefit of provisional patent application No. 62/821,322, Confirmation Number 5200, filed Mar. 20, 2020 by the present inventor.

FEDERALLY SPONSORED RESEARCH

None

SEQUENCE LISTING

None BACKGROUND:

Traditionally the majority of electric stringed instrument bodies are made of wood using one of three different construction methodologies. The majority are constructed of solid wood and referred to as Solid Body instruments, comprising either one piece of wood or a plurality of pieces glued together and with all construction details machined into said body using routing, cutting, drilling, etc. Said details include but are not limited to exterior shape, cavities for electronic pickups, mounting holes for the bridge location, cavities and through holes for control installation, and a neck joint of some type.

The second type of electric stringed instrument construction is referred to as Semi-Hollow Body, in which a top surface, a back surface, and sides of a given thickness are glued together over a center block that runs through the middle of said semi-hollow body. The center block is glued to the top, back and sides at all points of contact generally leaving hollow areas on either one or both sides of said center block. Said sides are generally fully enclosed around the perimeter of said instrument. Similar to Solid Body instruments, the body is machined to provide a plurality of cavities for controls, pickups, neck pocket, etc. The advantage of this construction methodology is that it yields a lighter weight and generally more resonant instrument, the disadvantages are that it is complicated and difficult to build, repair, and modify.

The third construction methodology is referred to as Hollow Body. This is essentially the same methodology as is used in purely acoustic stringed instruments (vs electric stringed instruments) with a top surface, a back surface, and sides of a given thickness all glued together to form a united hollow instrument body. As with Semi-Hollow body instruments the sides are enclosed around the perimeter of said instrument body. This methodology further increases the resonance of the instrument but is once again complicated to build, repair, and modify. Instruments constructed this way are often prone to "feedback" at higher volumes. Feedback occurs when the instrument body resonates in sympathy with the sound coming out of an amplifier in an open loop fashion thereby increasing in volume. Feedback is generally unwanted, unpleasant to listen to, and undesired.

A driving reason behind the need for these complicated assembly techniques is the fact that stringed instruments are under significant stress from the tension forces produced by the strings when said strings are tightened to the correct pitches. Using guitars as an example, it is not uncommon for guitars with metal (as opposed to nylon) strings to see total string loading on the order of 120-220 pounds. At one end this loading or force acts along the neck from the tuners across the nut and down said neck. Because the strings cross the nut at an angle and some distance from the neutral axis of said neck the string forces are in essence trying to twist the headstock of the guitar off. At the other end of the strings said strings pass over a bridge which is generally located roughly ⅔ of the way back along said guitar body from where the neck and the body join. The point where the strings cross over the bridge and angle downward is elevated off of the surface of said guitar by anywhere from ¼ inch to more than an inch depending on guitar geometry. This creates large compressive and twisting forces on the face of the guitar that are transferred to the back and sides of said instrument. The net effect of this is that the string forces create a large bending moment that in essence attempts to pull the two ends of the guitar together while pushing down in the middle of the instrument's body. Said stringed instrument must also be stiff enough to resist more than a few thousands of an inch deformation due to these forces because if the neck and body deflect the tone and playability of the instrument will be degraded often resulting in an undesirable or unusable instrument. Excessive deformation of the system is difficult to precisely define because a stringed instrument is generally an asymmetrical body (even acoustic instruments are braced asymmetrically inside) and therefore the loads placed upon it by the strings are distributed unevenly. Each individual string also imparts a unique load to the system because each string is a unique diameter and requires a specific tension to bring it to pitch, with the bass strings requiring more tension than the treble strings (there are "even tensioned" string sets available where each string has equal tension at pitch but they represent a small percentage of the overall market). Each individual instrument design also has its own unique neck to body joint, neck design, and truss rod design, making predictive modeling even more difficult. Stringed instruments can therefore distort and deform in myriad ways including but not limited to bowing along the neck/body axis, twisting upward where the neck and body join, or twisting asymmetrically and unpredictably throughout the system. The spacing of the strings with relation to the neck, both in terms of height off of and spacing across said neck is one of the most important dimensions in stringed instrument construction and if these dimensions are incorrect or uncontrollable then the instrument is, for all practical purposes, unusable. As a rule of thumb, using guitars as an example, if the body of a guitar deforms enough that the strings are more than 3/16th inch off of the neck measured at the 12th fret, the midpoint of said string, that is generally considered an unusable instrument (the exception being instruments that are played using a "slide", a piece of hard material that slides along the strings in order to change the effective string length and therefore the note being played). For the purposes of this design with respect to only guitars excessive deformation can generally be defined as system deformation that results in the string to neck height at the string mid point changing by more than 0.030" when the strings are tensioned to pitch or where the side to side dimensions change by 0.020" at the same location. Other instruments will have different deformation tolerances.

The large amounts of wood and complex assembly techniques used in stringed instrument construction are largely a result of these string forces, and most of these techniques were developed decades if not centuries ago. Modern materials including but not limited to carbon fiber composites, fiberglass, fiber/wood matrices, and even modern plywoods allow these design methodologies to be revisited and updated, offering the opportunity for improved designs in terms of tone, strength, weight, ergonomics, maintainability, modifiability, repairability, etc.

Numerous other methodologies for electric stringed instrument body construction have been used and/or attempted across many years. Designs with a combined neck and center block but without side "wings" have existed for decades, the most fully developed of these was likely the Steinberger guitar from 1980 U.S. Pat. No. 4,192,213A Stringed Musical Instruments Steinberger and various people have added modular "wings" to these designs in order to make said instruments more aesthetically attractive, ergonomically efficient, and/or commercially acceptable. An example of this is shown in U.S. Pat. No. 6,194,644B1 Modular Guitar Hendrickson. In Hendrickson the user attaches guitar body modules to a neck and center block chassis. Other designs have used a two plate architecture for the guitar body in order to reduce material costs or in an attempt to improve the acoustic behavior of said instrument. Examples of this type of approach can be seen in U.S. Pat. No. 6,774,291B2 Electric Guitar or Electric Bass Vartiainen (expired) or US Application #US20080105101A1 Eldring (Abandoned). In the first instance (Vartiainen) there is no center spine or block, the design is simply a front plate and a back plate bolted together using screws and small spacer plates. The neck is simply bolted to the back plate. The second example (Eldring) utilizes a sculpted top plate, a sculpted back plate, and a complex neck to body joint in order to create the desired resonance properties. The plates have no claimed structural effect on the system and in the preferred embodiments the system is glued together with an optimum plate to plate spacing of 5 mm. By design the plates do not touch each other anywhere but down the center, going so far as to have a jack plate mount that keeps the top plate and bottom plate from contacting. Said plates are acoustically coupled via air moving in response to plate vibration. Another architecture that was recently patented is a guitar with a replaceable top plate U.S. Pat. No. 9,305,525B2 Interchangeable Guitar Faceplate and Guitar Body System Park, Emery. In this design all electronic elements of an electric guitar are mounted on a top plate that attaches to a back and neck assembly. By replacing one top plate with another you can change the characteristics of the instrument. This design is limited in that only the top plate can be replaced and the interior areas of the guitar cannot be used for the placement of electronics, tone shaping effects, etc., because the top plate cannot be electronically connected to the rest of said instrument. Again, no claims relating to loads, stresses, or structural elements are made in the above patent.

These instrument body architectures have numerous disadvantages. Solid Body instruments use a large amount of wood, are generally heavy, and have limited capacity for changing pickup and control configurations and no generally well known or practiced techniques for changing the tone of the body itself. The tone of existing instrument types is heavily determined by the type and quality of the material used for both the neck and the body as well as the quality of construction and design of the instrument itself. This makes it difficult to predict the tone of an instrument until it had been built and tested and if the tone is unpleasant or undesired there are limited ways to modify it or repair the instrument. In some guitar architectures such as Fender Stratocasters it is possible to change the guitar's pick guard, pickup and control assembly as a unit and in instruments with a bolt on neck the neck may be replaced to affect a tonal change in the instrument or to change the way the neck feels to the player's hand, but most instruments have limited ability to correct for tonal deficiencies or to change the control configuration or ergonomics to better suit the player's needs. Another deficiency with most electric instrument architectures is that they require the use of large amounts of ever dwindling supplies of wood, many of which come from environmentally stressed or politically unstable areas.

SUMMARY

A new modular approach to the construction of stringed instrument bodies comprised of a "front plate" of a given thickness, a "back plate" of a given thickness, and a series of structural pieces that attach to and hold said plates a given distance apart. Said structural members include a central stiffening member, "spine", or "tongue" (hereafter referred to as the spine) that runs through the center of said instrument body, as well as a plurality of spacer or "bout" blocks distributed around the perimeter of said plates. Said plates and structural members may be attached together with screws, bolts, glue, or some other attachment methodology.

Said spine may either be a single piece, an assemblage of pieces, or part of a monolithic integrated neck and spine assembly. All of these variants are shown and described in the drawings. When not part of an integrated neck and spine assembly said spine provides an attachment point for an instrument neck. Configured within the spine, if required, are recesses for electronic pickups and attachment points for an instrument bridge of some type. The spacer blocks are distributed radially around the perimeter of said plates and are placed in such a fashion as to provide mounting points for items such as strap buttons and jack plugs.

Although said plates are not limited in their material, in the preferred embodiment said plates are constructed out of carbon fiber composite. This allows them to be significantly thinner and lighter than in prior multi plate designs, and it enables the plates to be shaped asymmetrically in order to create improved ergonomics. It also allows said plates to be easily machined for all component mounting details including spine and spacer block attachment points.

When said plates, spine, and spacer blocks are assembled to form an instrument body the individual pieces all act to create a beam structure designed to withstand the forces created by string tension. In the preferred embodiment neither the spine nor the plates alone can withstand the string forces without undue deformation or even outright destruction (as described earlier) but by distributing the string forces throughout said instrument body the entire assembly creates a functional instrument. Said instrument body can be viewed as a combination I-beam and box beam that resists excessive deformation by using the plates as the flanges of an I beam, the spine as the web of said I beam, and the spacer blocks as partial walls of said box beam. In the preferred embodiment the plates are held between ½ inch and 3 inches apart by said spine and spacer blocks and said plates are ¼" thick or less. Making the individual pieces of said assembly structurally insufficient in and of themselves means that the entire assembly uses less materials more efficiently than in traditional construction methodologies. The limited energy from a plucked or bowed string is distributed throughout said system more efficiently making the instrument more resonant.

Said architecture reduces weight and material usage while at the same time increasing resonance, response, repairability, and modifiability with respect to tonal characteristics, electronics and controls, and aesthetics. The entire modular assembly can be made out of a multitude of materials including but not limited to wood, composites such as carbon fiber, fiberglass, metal, or plastic.

DRAWINGS

FIG. 1. is a perspective upper right side view of one embodiment in assembled form.

DETAILED DESCRIPTIONS

Figure 1:
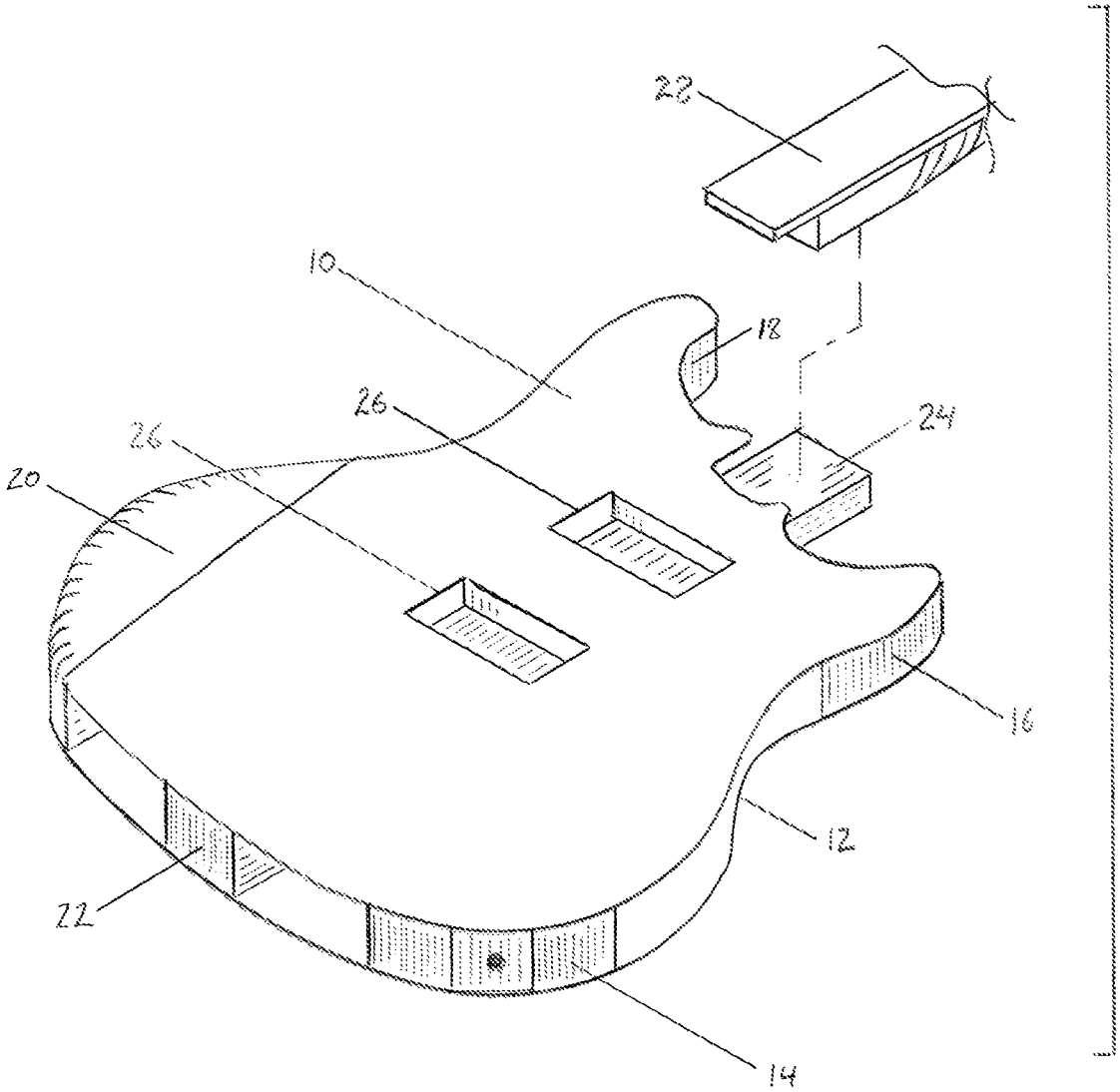

The following is a detailed description of the embodiments presented in the drawings. These embodiments are not intended to limit the scope of the claims and are provided only as examples. The embodiments shown in the drawings are guitars but the architecture can also be used for other stringed devices including but not limited to violins, mandolins, etc. The shapes and spacing of all components can be varied in order to meet the required design parameters.

ADVANTAGES

In some embodiments this device uses less material while giving a user more control over the frequency response and visual aesthetics of the instrument and its pickup and control configuration than previous designs. The use of less material combined with the use of more modern materials also means that some embodiments weigh significantly less than existing construction methodologies. When mechanically assembled (using screws, bolts, etc.) said device also allows for the modular replacement of system components without the need to replace or modify any of the other components. This modularity improves modifiability, maintainability, and repairability over existing designs. For example, the user could replace the front plate with one of a different material or different control and pickup configuration, using standard hand tools, potentially without needing to replace any other component because all mounting holes and dimensions are standardized from component to component. This gives a musician nearly unlimited control over his instrument's tone, appearance, control configuration, etc. In other embodiments the spine could be replaced with one of a different type of material in order modify the resonance properties of the system to suit said user. For example a user could change a wood spine to an aluminum spine with no other changes to the system. In some embodiments the user could be able to replace any component in the system with one made of different material or of different design and as long as the components are designed to facilitate this there should be no change in any other component. Different embodiments of said device may also use a plurality of materials including but not limited to wood, metal, plastic, composites such as carbon fiber, etc., allowing for more efficient and/or effective use of materials while enabling new design decisions.

The device also uses the limited energy of a plucked, strummed, or bowed string more efficiently than an instrument constructed using existing methodologies because there is less material to excite and said material is necessarily stiffer in order to create the required structural rigidity. In general this yields a quicker response with longer sustain. All components of the system can be tuned in order to create the frequency response and sustain characteristics the player desires through a variety of means including but not limited to; changing to a different material, adding or removing material either via initial molding, machining, attaching additional tone modifying pieces via adhesives or mechanical mounting, or molding details and curves into them during production. The resonance structure of some embodiments can also be modified by changing the shape, material, and location of the corner blocks or the spine. In short, the user has improved control over the variables in the system with respect to frequency response, tone, etc.

Another advantage of said device is that should the user desire the use of wood for the spine, spacer blocks, etc, the design uses much less wood than most current instrument construction methodologies and doesn't require the use of large pieces of material that are often common in standard instrument raw materials dimensioning. Instruments in general sound better when made out of large pieces of material in order to minimize joints and the modifying effect they have on vibrations passing through said joints. As an example guitar body raw materials are predominantly sold in semi-standardized dimensions of either the full width of a guitar body, which is generally between 13 to 20 inches, or the half width of said body, seven to ten inches (there is almost always some wood at the edge of the material "blank" that is cut away and discarded). In order to get a structurally useful piece of wood with an appropriate appearance for guitar construction this raw material must come from trees that are often many decades, if not hundreds, of years old. The device being claimed here not only uses much less material but it can use smaller pieces from younger trees while still meeting all structural and aesthetic requirements.

Because said plates that have significant accessible open areas between them compared to conventional construction methodologies said open areas can be used for the installation of components or subsystems such as electronics, lighting, wireless transmission modules for the guitar signal, modular effects devices, control enclosures and shielding, phones, etc.

In some embodiments the plates can be shaped in order to improve ergonomics, aesthetics, etc. As an example, the front plate and back plate can be sculpted such that the apex of the concave bottom curve in said front plate is located closer to said instrument's neck than the apex of the concave bottom curve of said back plate. This allows the instrument to sit in the player's lap at the correct location and angle for optimum playing comfort and ergonomics. The back plate top concave curve of said back plate can also be cut more deeply into the back plate than the front plate top concave curve is cut into the front plate in order to provide a "tummy cut" that allows said guitar to rest more closely to the player's body again improving ergonomics. Examples of these embodiments can be seen in the drawings. It can be seen that this device architecture opens up new possibilities for electric instrument design FIG. 1 is an upper right side perspective view of an embodiment in accordance with the invention that shows the system in assembled form. Included in FIG. 1 is a Front Plate With Armrest Cutout 10, a Back Plate 12, a Jack Block 14, Lower Bout Spacer Block 16, Upper Bout Spacer Block 18, Removable Arm Rest 20, Rear Strap Button Spacer Block 22, Spine 24, and Guitar Neck 28. Also included in FIG. 1 are the Electronic Pickup Cavity Holes 26 in the Front Plate With Armrest Cutout 10 for the placement of electronic guitar pickups of the type used in standard electric guitar construction. The Front Plate With Armrest Cutout 10 and Back Plate 12 are shown in this embodiment with nominal thickness. Not shown in FIG. 1 are a bridge, guitar controls or electronic pickups, or any attachment method for attaching said parts together. These details have been left out for clarity's sake. The pieces (front and back plates, spacer blocks, etc.) in the system can be attached to each other via any number of attachment mechanisms including but not limited to glue, screws, and bolts. In this embodiment the Front Plate With Armrest Cutout 10 and Back Plate 12 are held apart and in position by the series of Spacer Blocks 14,16,18, and 22, and the Spine 24. The neck 28 can either be bolted or glued on depending on user preference and neck type. The entire instrument body, when assembled, acts as a beam structure to resist the string forces with the spine acting as the central member or web of an I beam, the plates acting as the flanges of said I beam, and the spacer blocks acting as partial sides of a box beam.

Figure 2:
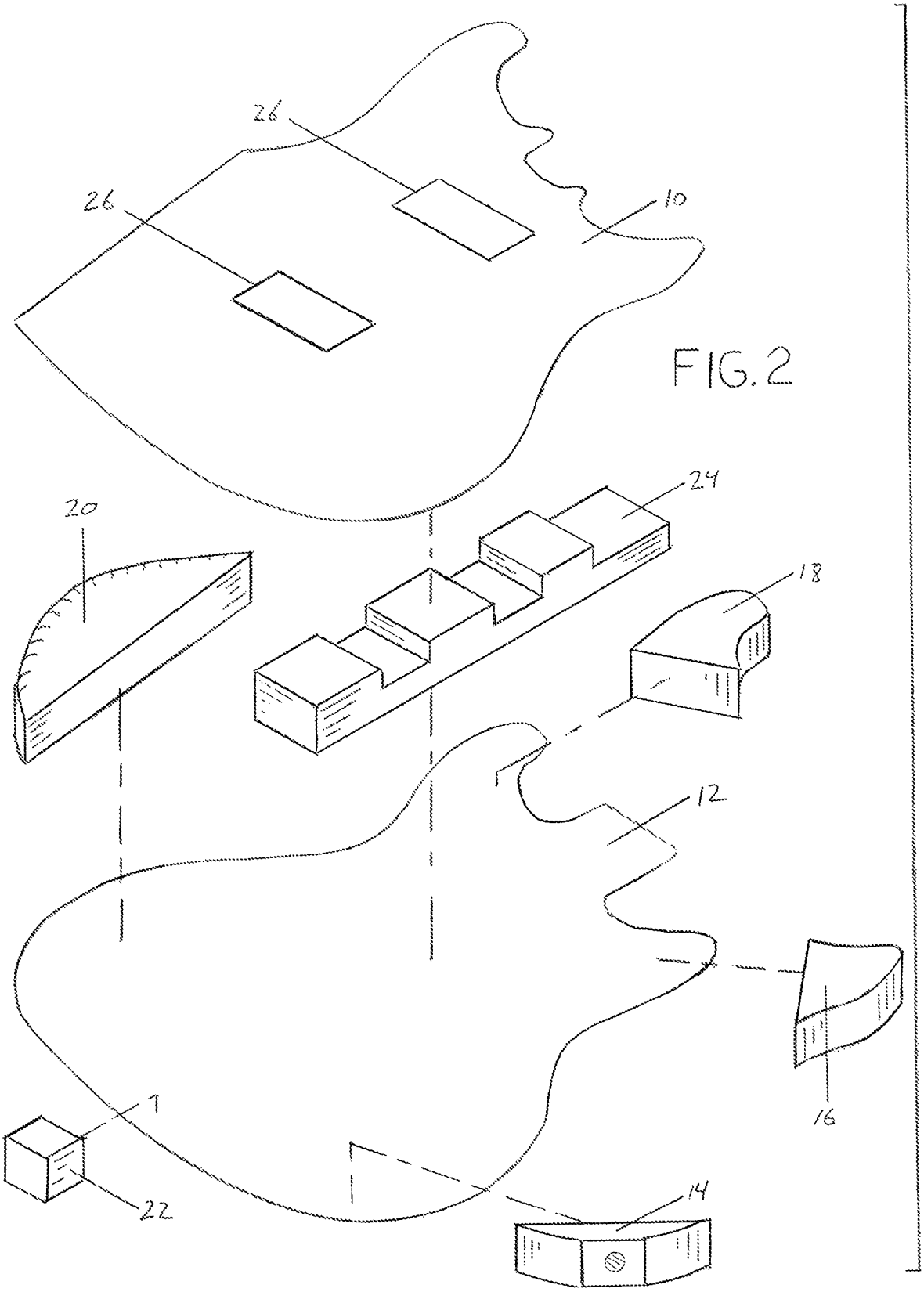
FIG. 2 is a perspective upper right side exploded view of the embodiment shown in FIG. 1.

FIG. 2 is an upper right side perspective exploded view of the embodiment as shown in FIG. 1. Shown in FIG. 2 are the Front Plate With Armrest Cutout 10, Back Plate 12, Jack Block 14, Lower Front Bout Spacer Block 16, Upper Front Bout Spacer Block 18, Removable Arm Rest 20, Rear Strap Button Spacer Block 22, and Spine 24. Not shown in FIG. 2 are a bridge, guitar controls or electronic pickups, or any attachment method for attaching the parts together. These details have been left out for the sake of clarity. In FIG. 2 the locations of the various parts of the system can be seen in greater detail. The Electronic Pickup Cavity Holes 26 in the Front Plate With Armrest Cutout 10 can be seen to line up with the cut outs in the spine 24 that create room for the electronic pickups and one set of potential embodiments for the various spacer blocks can also be seen.

Figure 3:
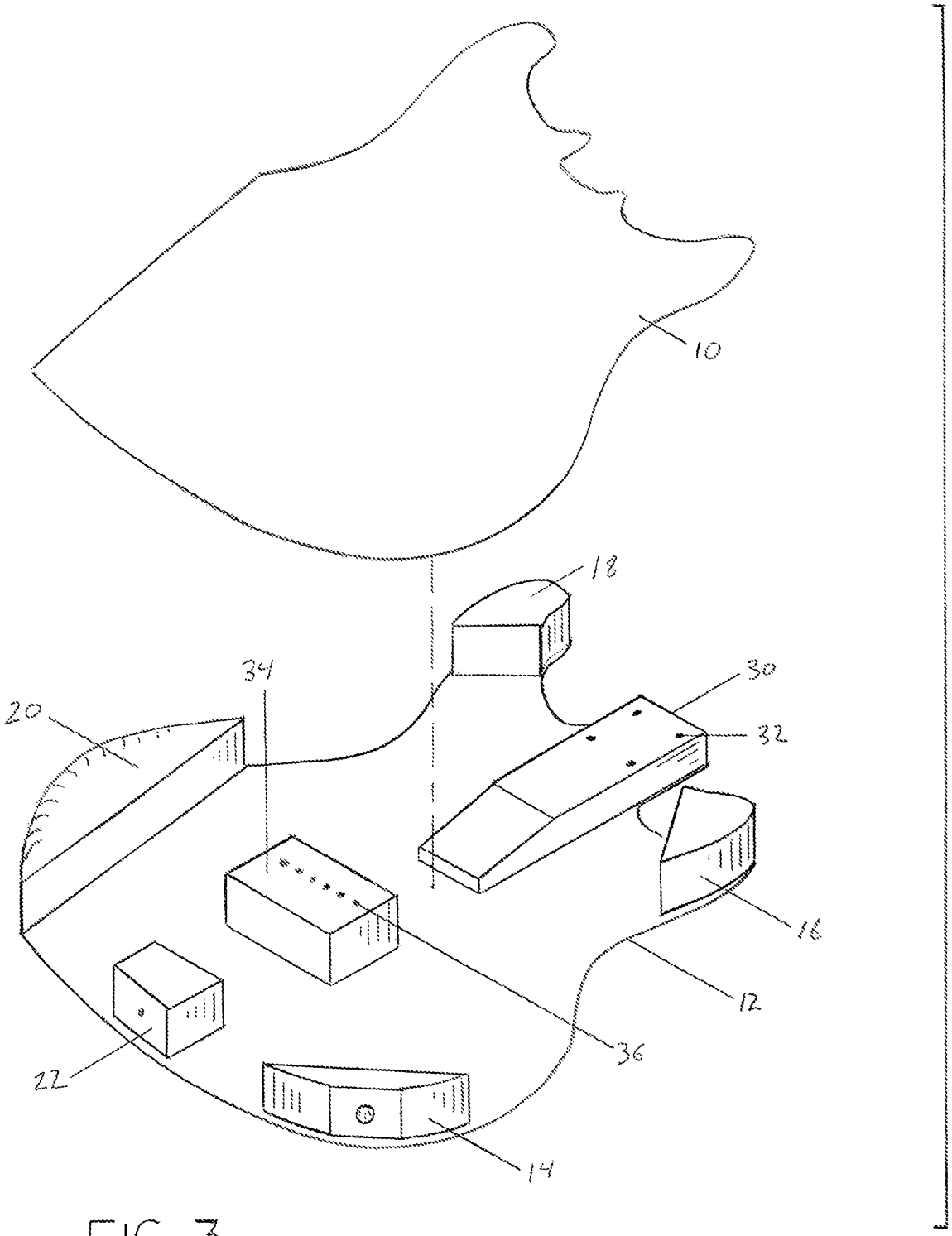
FIG. 3 is a perspective upper right side exploded view of another embodiment.

FIG. 3 is an upper right side perspective exploded view of an embodiment in accordance with the invention. In FIG. 3 all parts are shown located in their correct positions on Back Plate 12 while the Front Plate With Armrest Cutout 10 is exploded upward. There is no guitar neck shown, the plates are shown with nominal thickness, and there are no pickup cavity holes shown. In this embodiment the Spine 24 shown in FIGS. 1 and 2 has been replaced with a Tongue 30 and a Bridge Block 34. Also shown are the Neck Mounting Holes 32 in the Tongue 30 that are used to bolt on a guitar neck. In the Bridge Block 34 there can be seen Through Holes In Bridge Block For String Through Body 36 that enable the guitar strings to pass over the bridge on the Front Plate With Armrest Cutout 10 (bridge and through holes not shown) and go through the body to terminate on the back side of the instrument. By doing this the force of the strings is utilized to pull the Front Plate 10 and the Back Plate 12 together thereby increasing system stiffness and performance. The Tongue 30 distributes the twisting forces created by the strings pulling on the neck further back into the system where the twisting moments are reduced and there is more material. By distributing the stresses throughout the system the material required is reduced improving overall system performance. The Bridge Block 34 keeps the Front Plate With Armrest Cutout 10 and Back Plate 12 from deforming toward each other due to the string forces and at the same time has a tone shaping affect on the system due to its inherent resonance properties. The stiffness of the front plate and back plate can be varied in order to modify the geometry of the system as shown in accordance with the desires of the user allowing for the use of thinner or smaller spacer blocks, a shorter or longer tongue, the removal of the Bridge Block 34, etc. Such modifications will affect the properties of the system giving the user control over parameters such as tone, weight, appearance, cost, etc.

Figure 4:
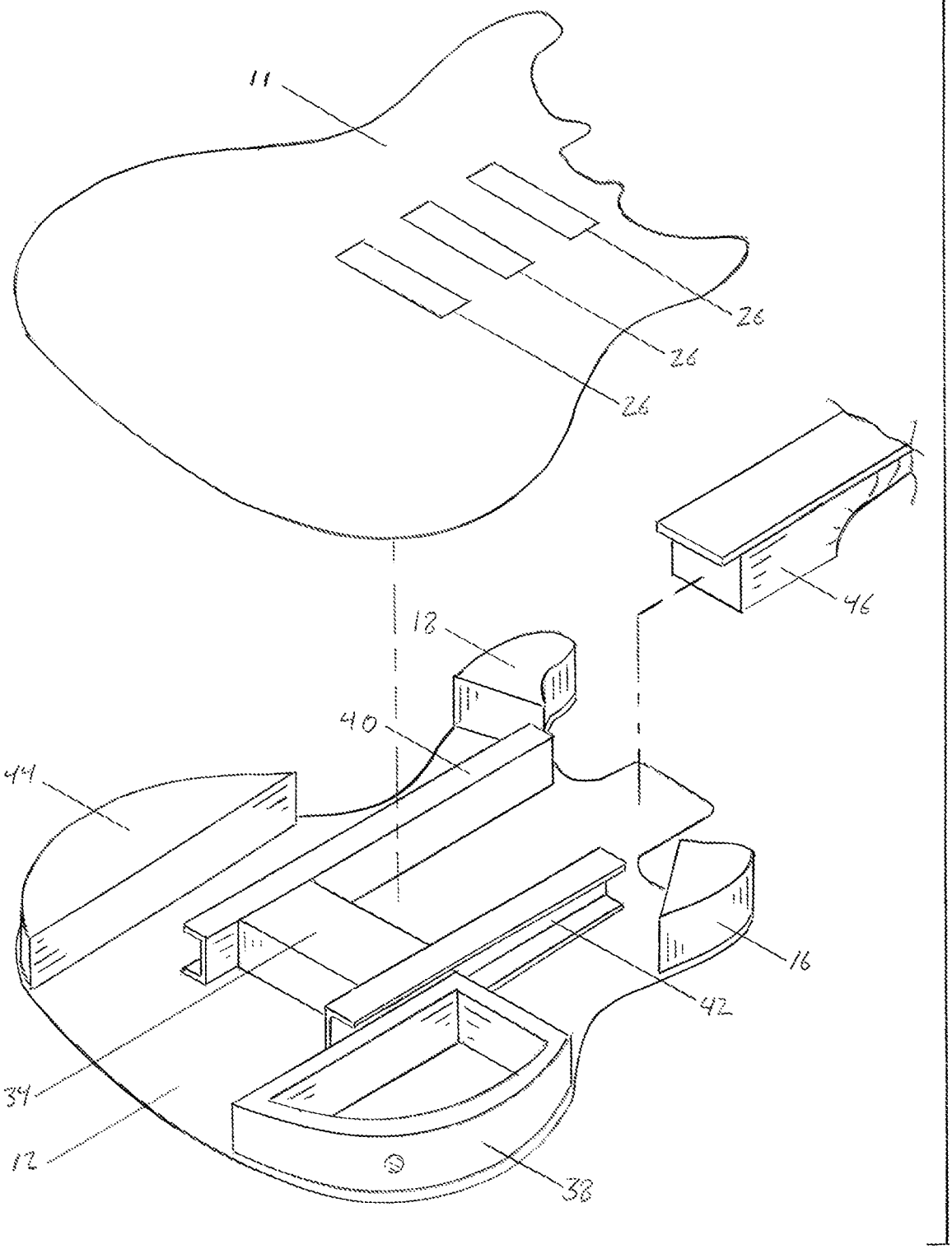
FIG. 4 is a perspective upper right side exploded view of another embodiment.

FIG. 4 is an upper right side perspective exploded view of an embodiment in accordance with the invention. In FIG. 4 all parts are shown located in their correct positions on the Back Plate 12 while the Front Plate Without Armrest Cutout 11 is exploded upward. In this embodiment the Spine 24 and/or Tongue 30 have been replaced with an Upper Plate Stiffener 40 and Lower Plate Stiffener 42. Also shown in this embodiment is a Guitar Neck With Full Heel 46 and a Control Enclosure With Integrated Jack Bracket 38. There is no arm rest in this embodiment, the Removable Arm Rest 20 has been replaced with an Upper Rear Bout Spacer Block 44 and the Front Plate Without Arm Rest Cutout 11 has replaced the Front Plate With Armrest Cutout 10 embodiment shown in the earlier drawings FIG. 1-3. In this embodiment the Front Plate Without Arm Rest Cutout 11 acts as the arm rest and the Upper Rear Bout Spacer Block 44 acts to hold the Front Plate Without Armrest Cutout 11 and the Back Plate 12 apart while adding rigidity to the overall system. The Upper Plate Stiffener 40 and Lower Plate Stiffener 42 act as stiffening members for the entire system and may be attached to said plates via a plurality of means including but not limited to glue, screws, bolts, etc. Said stiffeners may also extend toward the neck of the instrument and enclose or attach to said neck in order to create a more secure neck to body joint. The stiffeners shown are one potential embodiment and other embodiments could be of different shapes and quantity. Potential materials include but are not limited to wood, plastic, metal, carbon fiber, etc. Also shown in FIG. 4 are embodiments of the Bridge Block 34, the Lower Front Bout Spacer Block 16, the Upper Front Bout Spacer Block 18, and Electronic Pickup Cavity Holes 26. In the embodiment shown there are three Electronic Pickup Cavity Holes 26 instead of the two shown in other embodiments of said front plates. The Control Enclosure With Integrated Jack Bracket 38 is shown in one potential embodiment and could be varied to enclose numerous PC boards and control modules. It can be made out of numerous materials including but not limited to metal, wood, plastic (conductive or non-conductive), or carbon fiber.

Figure 5:
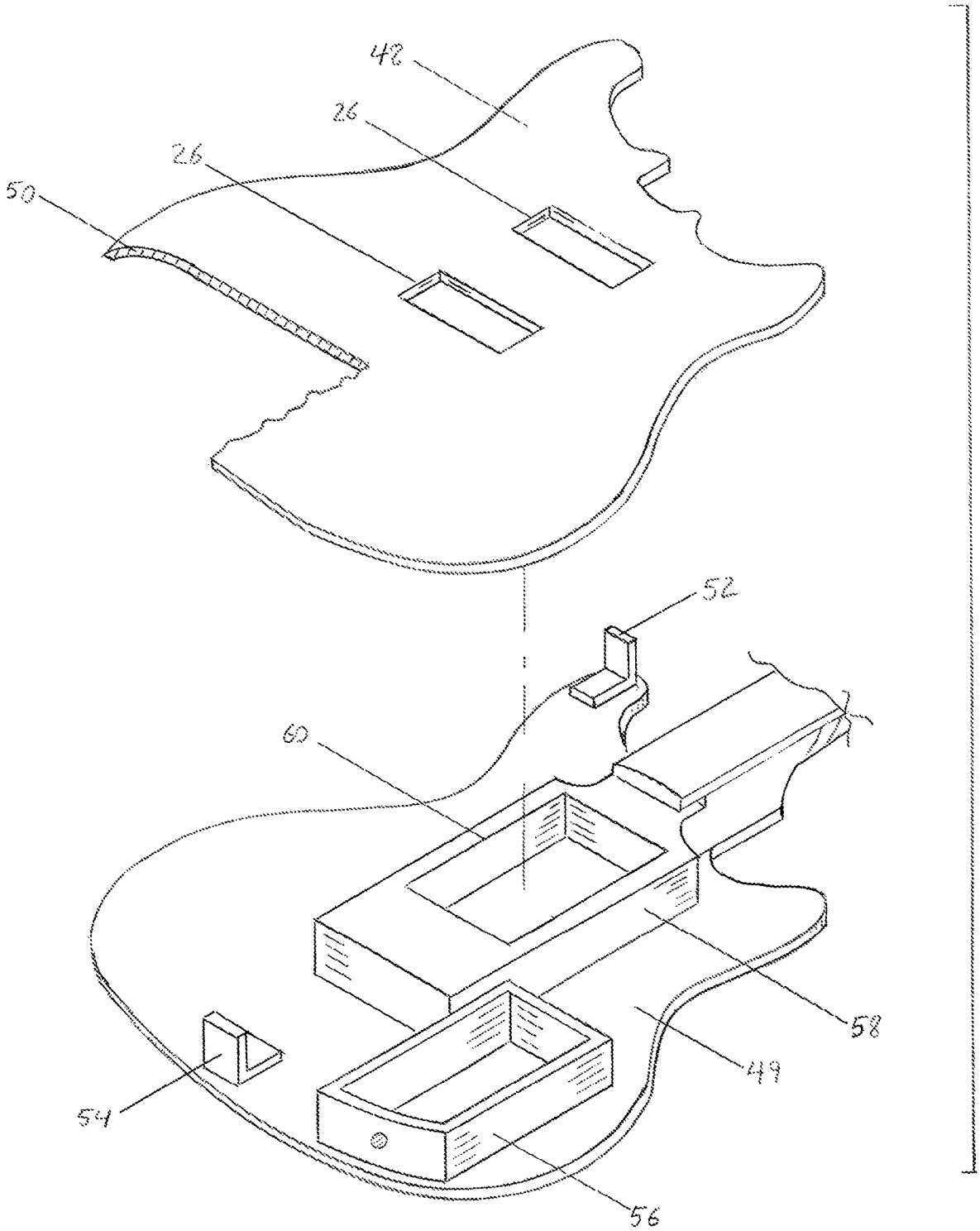
FIG. 5 is a perspective upper right side exploded view of another embodiment.

FIG. 5 is an upper right side perspective exploded view of an embodiment in accordance with the invention. In FIG. 5 all parts are shown located in their correct positions on the Back Plate With Additional Thickness 49 while the Front Plate With Integral Molded Armrest And Additional Thickness 48 is exploded upward. In this embodiment the Spine 24, Tongue 30, Upper Plate Stiffener 40, Lower Plate Stiffener 42, and Bridge Block 34 shown in earlier Figures have been removed and replaced with a monolithic Integrated Neck/Spine/Bridge Block Assembly 58 with a Universal Electronic Pickup Cavity 60. The Universal Electronic Pickup Cavity 60 enables the installation of a plurality of differing electronic pickup configurations depending upon the Electronic Pickup Cavity Holes 26 specified by the user. The Front Plate With Armrest Cutout 10 has been replaced with a Front Plate With Integral Molded Armrest And Additional Thickness 48 to show that some embodiments of the plates can have details such as curves molded into them. The Armrest Curve 50 can be seen in the cutaway portion of the drawing of said front plate. The spacer blocks shown in the earlier embodiments have also been removed.

A Front Strap Button Bracket 52 and Rear Strap Button Bracket 54 have been added as a means of providing attachment points for the strap buttons guitarists use to attach straps to their instruments. The use of a monolithic Integrated Neck/Spine/Bridge Block Assembly 58 is one embodiment that allows for the removal of nearly all other pieces of the system and indicates that embodiments without spacer blocks are viable. Another embodiment of a Control Enclosure With Integrated Jack Bracket 56 is shown in FIG. 5. This embodiment shows that the Modular Multi Plate Instrument Architecture works with monolithic neck assemblies while still providing the advantages of less weight, increased structural rigidity, enhanced ergonomics, etc.

Figure 6:
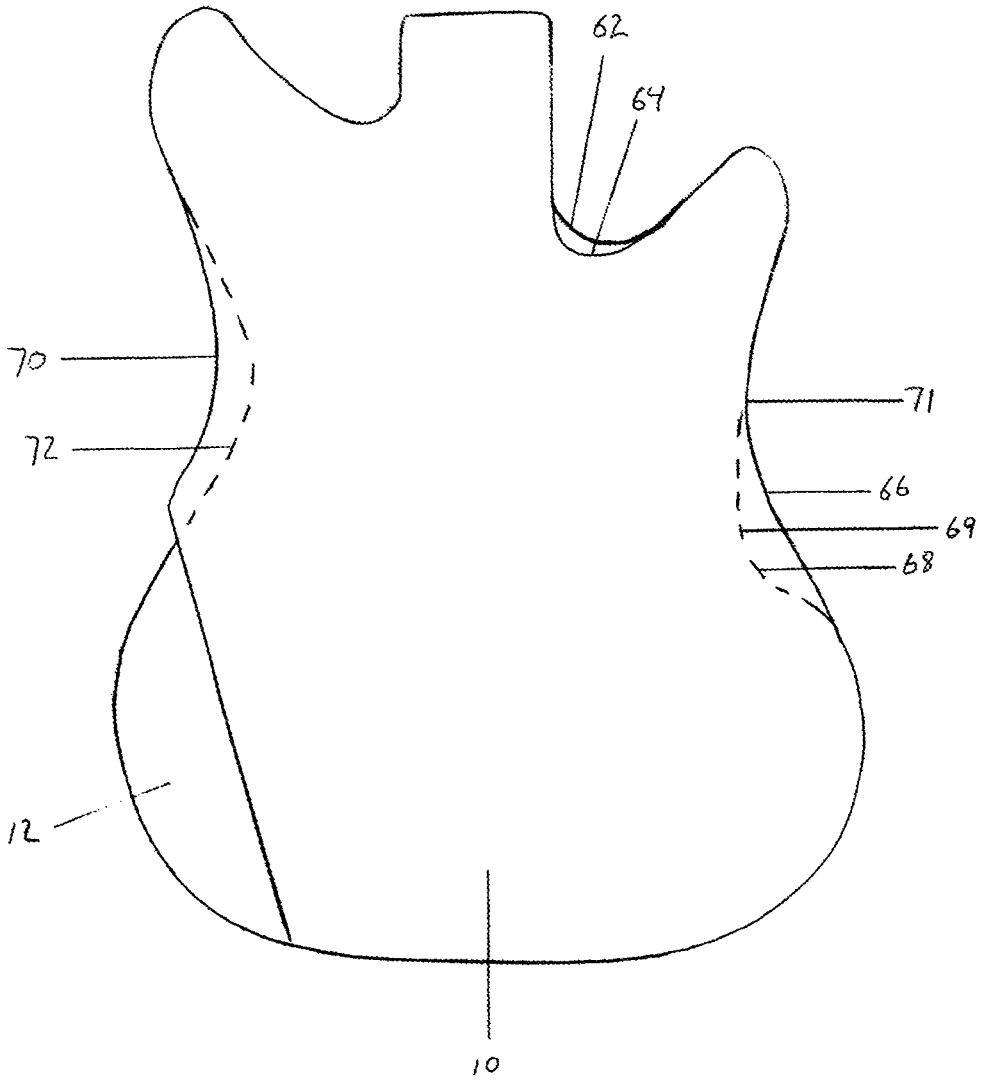
FIG. 6 is a plan view of the Front Plate With Armrest Cutout 10 and Back Plate 12 of said Modular Multi-Plate Instrument Body Architecture overlaid upon each other in order to show the difference in profile details between said plates.

FIG. 6 is a plan view of the Front Plate With Armrest Cutout 10 overlaid on top of the Back Plate 12 of said Modular Multi-Plate Instrument Body Architecture in order to show the difference in profile details between said plates. These profile differences improve the ergonomics of said instrument by changing the shapes of the plates with respect to each other. In FIG. 6 it can be seen that, for this embodiment, the Lower Front Bout Front Plate Cutaway 64 cuts more deeply into the Front Plate With Armrest Cutout 10 than the Lower Front Bout Back Plate Cutaway 62 cuts into said Back Plate 12. This difference in plate shapes allows for the player to more easily reach around the body of the instrument in order to play higher up the neck thereby improving the instrument's playability while still allowing for the Back Plate 12 to have maximum material around the neck to body joint in order to maintain maximum stiffness in a highly stressed area of the instrument. In FIG. 6 it can also be seen that, in this embodiment, the Back Plate Bottom Concave Curve 68 cuts more deeply into the Back Plate 12 than the Front Plate Bottom Concave Curve 66 cuts into the Front Plate With Armrest Cutout 10 and that the apex of said curves are offset from each other with the Front Plate Bottom Concave Curve Apex 71 being closer to the neck of the instrument than the Back Plate Bottom Concave Curve Apex 69. This enables the instrument to sit on a player's leg at an angle thereby making said instrument more comfortable to play when seated. This angled offset design works for solid body instruments as well. In FIG. 6 it can also be seen that, for this embodiment, the Back Plate Top Concave Curve 72 is cut more deeply into the Back Plate 12 than the Front Plate Top Concave Curve 70 is cut into the Top Plate With Armrest Cutout 10. This difference in plate profiles enables the instrument to sit more closely to the player's body while playing thereby improving comfort and ergonomics.

CONCLUSION RAMIFICATIONS AND SCOPE

Thus the reader will see that the above embodiments describe a musical instrument body architecture that provides a new and/or improved solution to previous architectures in numerous ways. Said architecture reduces the weight of the instrument while increasing it's repairability and modifiability and it enables the customer to perform their own repairs and/or modifications using common tools. It allows for the use of new and more modern materials while reducing of the use of expensive and ecologically endangered woods. It enables improvements in ergonomics and aesthetics and at the same time opens the door to new functionalities such as embedded wireless signal transmittal, lighting, signal processing for effects, etc. Said architecture also enables increased control over the frequency response of the instrument through various means such as changing part materials or geometries or adding or removing tone shaping devices thereby changing said instruments behavior to more closely align with a given user's requirements. In short, this new architecture significantly improves control over all aspects of instrument design, fabrication, modification, repair etc. while reducing the ecological footprint of said instrument.

What is claimed is:

1. A modular stringed instrument body architecture comprised of a front plate of a given thickness, a back plate of a given thickness, a central stiffening member, assembly, or spine, a plurality of spacer or bout blocks, and a control enclosure, said front plate and said back plate being held apart between one half inch and three inches by said spine and said spacer blocks, with said instrument body being completely held together by screws, bolts, glue, or other methodology, and with said instrument body assembly creating a modular beam structure, said front plate, said back plate, said spine, and said spacer blocks may be comprised of a single piece or a plurality of pieces and manufactured from a plurality of materials including wood, carbon fiber, kevlar, plastic, metal, or other material, said plates comprised of a plurality of shapes including flat, curved, or perforated or molded or attached details; said front plate, said back plate, and said spine allow the attachment of a stringed instrument neck through a plurality of attachment methods including glue, screws, or bolts, and said neck may be attached to said front plate, said back plate, said spine, or any combination of said front plate, said back plate, and said spine, said front plate and said back plate shaped to have improved instrument ergonomics, said front plate having a front plate bottom concave curve, a front plate bottom concave curve apex, a front plate top concave curve, and a lower front bout front plate cutaway, said back plate having a back plate bottom concave curve, a back plate bottom concave curve apex, a back plate top concave curve, and a lower front bout back plate cutaway.

2. The stringed instrument body architecture of claim 1 wherein individually said front plate, said back plate, and said spine are not structurally capable of withstanding forces created by string tension without undue deflection, deformation, or destruction, which when connected together said instrument body acts as a modular beam structure capable of withstanding said forces without undue deflection, deformation, or destruction and therefore create a usable instrument body.

3. The stringed instrument body architecture of claim 1 where said front plate and said back plate are constructed of carbon fiber, fiberglass, phenolic, kevlar, or other composite material.

4. The stringed instrument body architecture of claim 1 where said front plate and said back plate are one quarter inch thick or less.

5. The stringed instrument body architecture of claim 1 where a back plate bottom concave curve apex and a front plate bottom concave curve apex are offset from each other with said front plate bottom concave curve apex being closer to said instrument neck than said back plate bottom concave curve apex.

6. The stringed instrument body architecture of claim 1 where a back plate top concave curve is cut deeper into said back plate than a cut in the front plate's top concave curve.

7. The stringed instrument body architecture of claim 1 where a lower front bout front plate cutaway is cut deeper into said front plate than a lower front bout back plate cutaway in said back plate.

8. The stringed musical instrument body architecture of claim 1 wherein said instrument body has a control enclosure constructed of conductive material, said control enclosure being constructed of a plurality of materials.

9. The stringed instrument body architecture of claim 1 wherein said instrument body consists solely of said front plate, said back plate, and said spine, said front plate and said back plate being comprised of composite material, said front plate, said back plate, and said spine are not structurally capable of withstanding forces created by string tension without undue deflection, deformation, or destruction, which when connected together said instrument body acts as a modular beam structure capable of withstanding said forces without undue deflection, deformation, or destruction and therefore create a usable instrument body.

* * * * *